US005147233A

United States Patent [19]

Hannula

[11] Patent Number: 5,147,233

[45] Date of Patent: Sep. 15, 1992

[54] SWIMMER TRAINING PADDLE

[75] Inventor: Richard L. Hannula, Tacoma, Wash.

[73] Assignee: Han's Paddles, Inc., Tacoma, Wis.

[21] Appl. No.: 740,292

[22] Filed: Aug. 5, 1991

[51] Int. Cl.[5] ..... A63B 31/00

[52] U.S. Cl. ..... 441/56; 482/55

[58] Field of Search ..... 272/71, 116; 441/55-58; 440/101; 416/69, 74; 482/55, 111

[56] References Cited

U.S. PATENT DOCUMENTS

| | | | |
|---|---|---|---|
| Re. 28,855 | 6/1976 | Montrella | 9/307 |
| 1,535,896 | 5/1924 | Bociek . | |
| 1,621,693 | 3/1927 | Theobold . | |
| 1,786,451 | 12/1930 | Ribard | 416/74 |
| 3,397,414 | 8/1968 | Webb | 9/307 |
| 3,765,042 | 10/1973 | Montrella | 9/307 |
| 4,493,663 | 1/1985 | Richmond | 441/56 X |
| 4,509,744 | 4/1985 | Beasley | 272/116 |
| 4,913,418 | 4/1990 | Schlueter et al. | 272/116 |

FOREIGN PATENT DOCUMENTS

| | | | |
|---|---|---|---|
| 2201929 | 9/1988 | United Kingdom | 440/101 |

*Primary Examiner*—Sherman Basinger
*Attorney, Agent, or Firm*—Kolisch, Hartwell, Dickinson, McCormack & Heuser

[57] ABSTRACT

A swimmer training paddle with a textured leading surface for increasing a swimmer's arm strength and hand stability is disclosed. The paddle takes the form of a rigid, planar fluid resistance member having a textured first surface that directs and momentarily captures water thereon and a second surface configured to engage a swimmer's hand. The momentary capture of water by the textured paddle increases the thrust achieved with each stroke. Water resistively contacts the textured surface of the paddle for a longer period of time than does water contacting the smooth surface of a conventional paddle. In the preferred embodiment, the textured surface comprises diagonally extending, interconnected, contiguous linear recesses or channels which have been found to provide increased thrust without compromising rotational stability.

8 Claims, 1 Drawing Sheet

SWIMMER TRAINING PADDLE

BACKGROUND AND SUMMARY OF THE INVENTION

This invention relates generally to swimmer training paddles used for body conditioning and stroke technique development. More specifically, the invention relates to an improved paddle that provides greater thrust while minimizing undesirable instability due to swimmer wrist rotation or oscillation.

A swimmer is propelled forward by displacing water rearwardly through the motion of his hands and feet. The swimmer's arm stroke is most efficient when his arm strength and hand stability are maximized. Hand paddles are generally used by swimmers to increase arm strength and stroke efficiency. Use of the hand paddle increases water displacement and thereby increases the thrust of each swimming stroke. Use of a paddle also increases the moment, or tendency of the swimmer's hand to rotate, due to the usually large size of the paddle relative to the size of the hand. The swimmer must counteract this increased rotational tendency in order to maintain the stability of his hand as it moves through the water. Hand stability permits the swimmer to maximize water displacement, and thus determines the efficiency of each stroke.

Improving hand stability involves preventing uncontrolled hand movement, e.g., oscillation, about a rotational axis running through the swimmer's elbow, wrist and middle finger. Prior art paddles exhibit problems because as the paddle size is increased to increase arm strength, the tendency of the paddle to rotate also increases. Since a swimmer's wrist strength, and the corresponding ability to counteract uncontrolled rotation of the paddle, is usually less than the swimmer's arm strength, the size of prior art paddles is greatly limited by the wrist strength of the swimmers.

There is a need in the industry for a swimmer training paddle that promotes greater arm strength without a corresponding increase in the oscillatory rotational tendency of the paddle.

Accordingly, it is a principal object of the invention to provide an improved swimming paddle that increases a swimmer's arm strength.

Another object is to provide such an improved swimming paddle that also increases a swimmer's hand stability.

An object of the invention also is to provide an improved swimming paddle in which the water-confronting surface area is increased without an undesirably large increase in the paddle's planar extent.

Another important object is to provide an improved swimming paddle that better frictionally engages water contacting the paddle.

Yet another object is to provide an improved swimming paddle which momentarily holds or captures water which contacts its leading surface.

It is another object to provide an improved swimming paddle which directs water encountered thereby during a stroke to flow in a direction transverse to the axis about which its tendency is to rotate in order to decrease its unstable rotational tendency.

Still another object is to provide such an improved swimming paddle configured for rotationally stable securement to hands of different sizes.

It is yet another important object of the invention to provide such an improved swimming paddle that is easy to manufacture and cost-effective.

Briefly summarizing the invention made in accordance with its preferred embodiment, an improved swimmer training paddle is provided with a generally rigid, angular, large-perimeter, planar expanse having formed therein a first set of regularly arrayed, plural apertures through which water can flow at a controlled rate. A second set of plural apertures smaller than those of the first set are provided for extending therethrough lengths of surgical tubing, wherein the lengths are made to form loops for securing one or more fingers of a swimmer's left or right hand to the expanse. A first, leading surface of the expanse is provided with water-holding means for controlling a volume of water in frictional engagement with the leading surface.

Preferably, the water-holding means is formed by texturing the leading surface of the paddle, preferably by forming therein a regular pattern of spaced recesses that extend linearly along intersecting axes that are diagonal to a given axis of the paddle about which there is a tendency to rotate. Such spaced, linear recesses preferably extend across the leading surface of the paddle contiguously from edge to edge. In accordance with a proposed modification, the water-holding means may take the form of plural, non-contiguous concave regions formed in or on the leading surface. The improved paddle increases the thrust of each stroke, while permitting a swimmer to maintain rotational control.

These and other objects and advantages of the present invention will be more clearly understood from the consideration of the accompanying description and drawings of the preferred embodiment.

DETAILED DESCRIPTION OF THE PREFERRED EMBODIMENT

Figure 1:
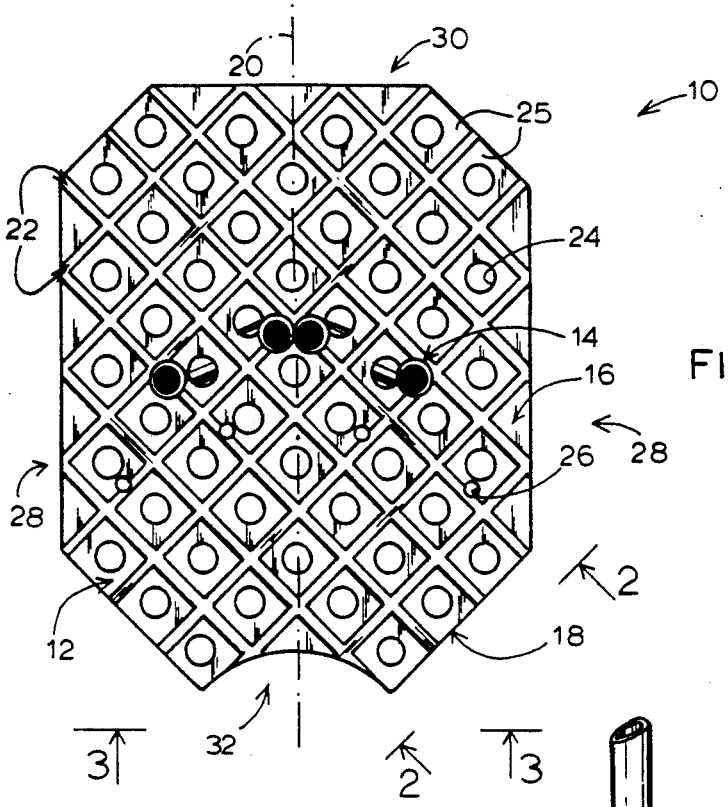
FIG. 1 is a top plan view of the improved swimmer training paddle made in accordance with its preferred embodiment.

Referring to FIG. 1, the preferred embodiment of the improved swimmer training paddle is indicated at 10. Paddle 10 is a hand-worn aquatic device comprising a generally rectangular, rigid, planar fluid resistance member or expanse 12 having opposite outer surfaces a first of which is textured to frictionally engage liquid confronted thereby and a second of which is configured to engage a swimmer's hand, e.g. by hand-securing tubing 14. More particularly, member 12 includes a first (leading) surface 16, and a second (trailing) surface 18. Paddle 10 has at least one given axis 20 about which there is a tendency when paddle 10 is in use for it to rotate, e.g. an axis which is generally parallel to an axis that runs through the swimmer's elbow, wrist and index finger when the paddle is secured to the swimmer's hand (not shown).

In accordance with the preferred embodiment of the invention, at least leading surface 16 of member 12 is textured with recesses 22 which act as means configured for directing a volume of water confronted thereby when paddle 10 is thrust through the water. Preferably, recesses 22 are arranged symmetrically relative to given axis 20 and are generally uniformly spaced, linear, contiguous, interconnecting channels lying generally in the plane of first surface 16 and extending along intersecting axes which are at an oblique angle to axis 20. Recesses 22 preferably extend substantially diagonally along two intersecting axes across first surface 16 to form a network of recesses. Alternatively, plural, non-contiguous concave regions may be formed in or on leading surface 16, which it is believed also would better frictionally engage and hold, thus controlling, a volume of water. In the preferred embodiment trailing surface 18 is generally smooth.

Textured surface 16 formed in member 12 increases the counterforce of the water on the swimmer's arm, without a corresponding increase in the rotational tendency of the paddle, in several ways. Recesses 22, also referred to herein as water-holding or water-controlling means, momentarily captures water confronting the paddle's leading surface 16, thereby increasing the time the water is in contact with the paddle. This increase in time corresponds to an increase in total resistive force by the water against the paddle. The volume of water in frictional engagement with leading surface 16 increases the traction between member 12 and the water when paddle 10 is thrust through the water. Recesses 22 also direct water generally towards a distal edge region 30 and a proximal edge region 32 of the paddle instead of directly laterally to edge regions 28 that are parallel to given axis 20 of paddle 10. By impeding the flow of water along an axis that is perpendicular to given axis 20 of paddle 10, the force of water against the paddle that would tend to cause it unstably to rotate is decreased.

Still referring to FIG. 1, interposing adjacent, linearly extending recesses 22 are plural holes or apertures 24 of a first group extending through member 12 from first surface 16 through member 12 to second surface 18. It may be seen that any two of apertures 24 are interposed by at least one of linearly extending recesses 22. The size, number and location of plural apertures 24, along with the configuration of recesses 22, provide a desired fluid resistance to member 12 by controlling the fluid dynamics of paddle 10 as member 12 is thrust through water. In the preferred embodiment of the invention, apertures 24 are regularly or uniformly arrayed within raised island regions 25 across member 12. Plural holes or apertures 26 of a second group, which apertures are small than those of the first group, are provided in member 12 for securing surgical tubing 14 thereto. Apertures 26 extend through member 12 from first surface 16 to second surface 18.

Proximal edge region 32 may be seen from FIG. 1 to have a concave, wrist-accommodating shape extending generally perpendicular to given axis 20. Lateral edge regions 28, distal edge region 30 and proximal edge region 32 define the perimeter of member 12, which perimeter is greater than that of conventional paddles. Preferably, the perimeter is generally rectangular, with angled corners as illustrated that facilitate good catch (water entry) and finish (water exit) of each stroke. Member 12 in accordance with the preferred embodiment is approximately 7-inches in width and 9-inches in length. Member 12 in its preferred embodiment is approximately ⅛-inch thick, with recesses 22 extending beneath leading surface 16 to a depth of approximately 1/32-inch. In the preferred embodiment, apertures 24 are approximately ⅜-inch in diameter and apertures 26 are approximately ⅛-inch in diameter. In its preferred embodiment, member 12 is injection molded from any suitable polymeric material by a suitably inexpensive manufacturing process employing conventional means. Those skilled in the art of course will appreciate that these material, shape and dimensional parameters may be changed without departing from the spirit of the invention.

Figure 2:
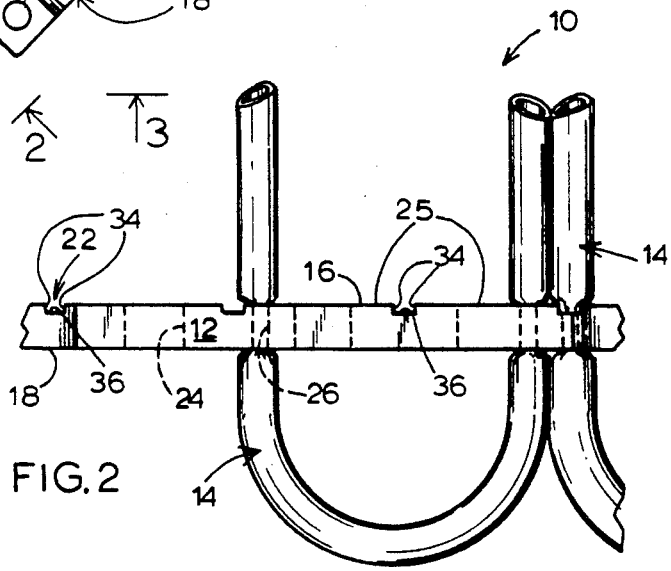
FIG. 2 is a corner elevation taken generally along the lines 2—2 of FIG. 1.

FIG. 2 is an enlarged, fragmentary, corner elevation of paddle 10 showing the detailed structure of tubing 14 and recesses 22. Each of recesses 22 may be seen to be generally right-rectilinear in cross section. Each of recesses 22 is defined by exposed, opposite sidewalls 34 that extend below first surface 16 and an exposed, bottom surface 36 that is generally planar and substantially parallel with leading surface 16. One or more lengths of surgical tubing 14 is crimped and forced through a pair of apertures 26 to form a finger-accommodating loop. Surgical tubing 14 does not easily pass through aperture 26 because the diameter of aperture 26 is smaller than the nominal (uncrimped) diameter of surgical tubing 14. Two free ends of surgical tubing 14 extend beyond an aperture 26 through which they pass. Thus, loops are formed by surgical tubing 14 with the loops extending above trailing surface 18 of member 12 with each loop sized to accommodate one or more of the swimmer's fingers and/or thumb (preferably abducted, to increase rotational control). The loops of surgical tubing 14 are configured to secure a swimmer's hand to trailing surface 18 of member 12. Preferably, plural, laterally spaced pairs of apertures 26 are provided as shown to allow a swimmer to arrange surgical tubing 14 in alternative hand-securing configurations including preferred configurations wherein the swimmer's index and ring fingers are accommodated by the loops.

Figure 3:
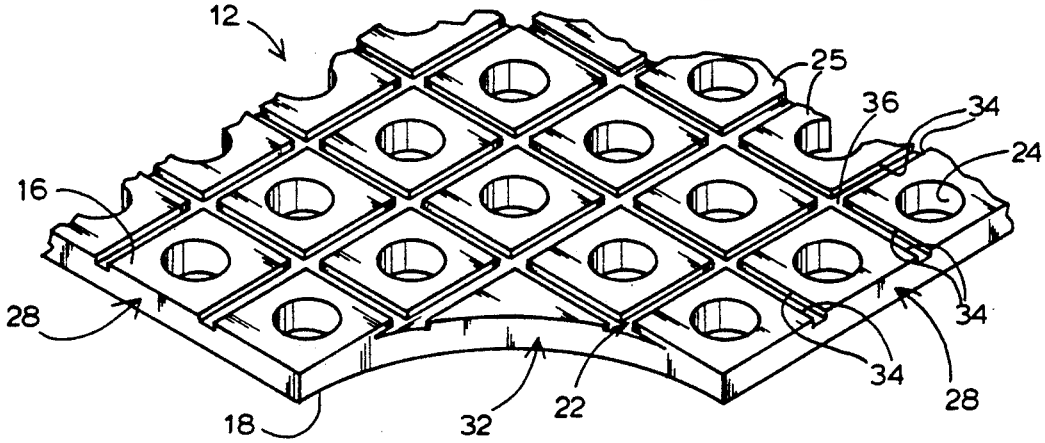
FIG. 3 is an enlarged, fragmentary, isometric view detailing the textured surface of the swimmer training paddle and taken generally along the lines 3—3 of FIG. 1.

FIG. 3 is a fragmentary, isometric view of paddle 10. As best illustrated in FIG. 3, recesses 22 in their preferred embodiment may be thought of as a plurality or network of interconnected channels extending contiguously from one edge region to another across leading surface 16 of member 12. Those of skill will appreciate from FIG. 3 that water flowing in recesses 22 meets the least resistance when it flows parallel to side walls 34 thereof. Otherwise, water flowing in recesses 22 encounters side walls 34, which act as a barrier to resist water flow.

When water in a swimming pool or the like contacts leading surface 16 of member 12, it follows a generally linear path of least resistance toward the closet edge region of the paddle. Due to the generally rectangular shape of member 12, the closer edge regions 28 are parallel to given axis 20 about which there is an undesirable tendency to unstably rotate, e.g. oscillate. As water moves toward lateral edge regions 28 of member 12, its distance from given axis 20 increases. The force of water against member 12 at a great distance from given axis 20 tends to rotate the paddle thereabout. Importantly, in accordance with the preferred embodiment of the invention, this tendency to rotate is believed to be minimized by the fact that water confronting leading surface 16 of member 12 is directed to move within channels along intersecting axes that are at an oblique angle to given axis 20.

Contiguous diagonal channels 22 of the preferred embodiment direct water on either side of rotational axis 20 to move at an angle that is preferably between 30° and 60°, and most preferably approximately 45°, to given axis 20. This 45° angle is the path of least resistance for water flow. Water flowing at 45° to given axis 20 does not flow directly to the closet edge region of member 12, but instead takes a longer path. Thus, the water engages leading surface 16 of member 12 for a longer period of time than it would if it were to flow more directly to closer edge regions 28. Thus, the traction of paddle 10 through the water is increased (requiring more thrust, or greater stroke force, by the swimmer) also as a result of the longer contact period. Yet the undesirable tendency of the paddle to oscillate as it is thrust through the water is not increased.

As noted in reference to FIG. 1, in addition to directing water flow, textured leading surface 16 of member 12 also momentarily captures and holds a volume of water contacting it because of increased friction therebetween. This momentary capture of water increases the time a given volume of water is in contact with paddle 10, increasing the resistance between the water and the paddle. Paddle 10 made in accordance with the preferred embodiment thus provides a larger surface area for greater traction and yet it does so without adversely impacting its rotational stability. Unprecedented power in each swimming stroke is attained, while control is maintained.

While the present invention has been shown and described with reference to the foregoing preferred embodiment, it will be apparent to those skilled in the art that other changes in form and detail may be made therein without departing from the spirit and scope of the invention as defined in the appended claims.

It is claimed and desired to secure by Letters Patent:

1. An aquatic device for use by a swimmer in a body of water, comprising:

a rigid generally planar member having lateral, distal and proximal edges, said member having formed therein plural apertures arrayed across said member to provide a desired flow of water through said member:

said member including water-channeling means formed in a leading surface thereof for controlling a volume of water in frictional engagement with said surface, thereby to increase traction between said member and such body of water when said member is thrust therethrough, the water-channeling means including a plurality of interconnected recesses interposing said apertures; and means for securing said member to a swimmer's hand.

2. The device of claim 1, wherein each of said recesses extends continuously between at least two of said edges of said planar member.

3. The device of claim 1, wherein substantially all of said recesses are obliquely oriented relative to said proximal and distal edges of said planar member.

4. An aquatic device for use in a swimming pool or the like, comprising:

a rigid fluid resistance member, including a plurality of edges, and first and second surfaces, said first surface being textured to frictionally engage liquid confronted thereby, wherein said textured surface includes at least two interconnected recesses forming an array of raised island regions, each recess extending continuously between two of said edges, said second surface being configured to engage a swimmer's hand; wherein said member has formed therein a plurality of holes, substantially all of said holes being located within said island regions.

5. The device of claim 4, wherein the ratio of holes to raised island regions is approximately one to one.

6. The device of claim 4, wherein each of said holes is substantially centered within one of said island regions.

7. A hand-worn device for use by a swimmer comprising:

a planar member having front and back surfaces, and proximal, distal and lateral edges;

said front surface of said member having formed therein a plurality of recesses, each recess extending continuously between at least two of said edges, said recesses being obliquely oriented relative to said proximal and distal edges of said member, said recesses being interconnected to form an array of raised island regions, wherein each of most of said island regions has at least one hole substantially centered within its borders.

8. The device of claim 7, wherein said recesses form angles between 30° and 60° with a given axis which is substantially perpendicular to said proximal and distal edges of said member.

* * * * *